US006711923B2

(12) United States Patent
Weyerstall

(10) Patent No.: US 6,711,923 B2
(45) Date of Patent: Mar. 30, 2004

(54) MOTOR VEHICLE LOCK

(75) Inventor: Bernd Weyerstall, Wuppertal (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/194,324

(22) Filed: Jul. 15, 2002

(65) Prior Publication Data

US 2003/0019262 A1 Jan. 30, 2003

(30) Foreign Application Priority Data

Jul. 24, 2001 (DE) ..... 101 35 218

(51) Int. Cl.[7] ..... E05B 47/00

(52) U.S. Cl. ..... 70/379 R; 70/276; 70/380; 70/DIG. 30

(58) Field of Search ..... 70/276, 379 R, 70/380, DIG. 30

(56) References Cited

U.S. PATENT DOCUMENTS

| | | | | | |
|---|---|---|---|---|---|
| 3,797,288 | A | * | 3/1974 | Hallmann | 70/276 |
| 5,050,410 | A | * | 9/1991 | Claar et al. | 70/237 |
| 5,265,453 | A | * | 11/1993 | Konii et al. | 70/379 R |
| 5,410,898 | A | * | 5/1995 | Shieh | 70/276 |
| 5,839,305 | A | * | 11/1998 | Aston | 70/283.1 |
| 5,878,610 | A | * | 3/1999 | Friedrich | 70/264 |
| 5,890,384 | A | | 4/1999 | Bartel et al. | |
| 6,268,790 | B1 | * | 7/2001 | Cregeur | 340/425.5 |
| 6,550,298 | B1 | * | 4/2003 | Su | 70/276 |
| 2002/0104343 | A1 | * | 8/2002 | Schwab et al. | 70/237 |

FOREIGN PATENT DOCUMENTS

| | | |
|---|---|---|
| DE | 37 17 778 A1 | 12/1988 |
| DE | 39 41 086 A1 | 6/1991 |

* cited by examiner

*Primary Examiner*—Anthony Knight
*Assistant Examiner*—Christopher Boswell
(74) *Attorney, Agent, or Firm*—Nixon Peabody LLP; David S. Safran

(57) ABSTRACT

A motor vehicle lock for the door of a motor vehicle which can be locked from the outside, preferably with a key and locking cylinder. The lock mechanism includes a force application element which is preferably a cylindrical nut that can be turned around an axis of rotation, and includes a measurement system for detecting the position of the nut. The measurement system can have at least one stationary sensor and at least one measurement element which is dynamically coupled to the nut of the lock and is located in the measurement range of the sensor in order to detect the position of the nut. The measurement element is located directly on the outside cylindrical surface of the nut while at the same time is made as a component which is separate from the nut of the lock.

28 Claims, 3 Drawing Sheets

MOTOR VEHICLE LOCK

BACKGROUND OF THE INVENTION

1. Field of the Invention

This invention relates to a motor vehicle lock having mechanical components, such as a lock latch, detent pawl, inside and outside actuation lever, and inside and outside safety lever. Today, motor vehicle locks increasingly include electrical or electronic components, such as electrical actuators and especially sensors for monitoring the current state of the motor vehicle lock mechanism.

2. Description of Related Art

When a sensor delivers information about the current state of a motor vehicle lock mechanism, such as the adjustment motion or the current position of individual force application components which accommodate the actuating force and motion to be applied to the lock mechanism, the sensor relays the information to other mechanical components of the lock mechanism. One element of a motor vehicle lock mechanism which can be monitored is a nut of the lock mechanism which in a certain situations acts on the outside safety lever. This nut is essentially cylindrical and can be turned around an axis of rotation.

In such a lock mechanism, the position of the nut of the lock is detected via a measurement system which preferably includes a sensor as well as a measurement element. Depending on the sensor, the location of the measurement element can be detected within certain limits. That is, in order for the position detection of the measurement element by the sensor to take place, it is necessary for the measurement element to be located at least partially within the measurement range of the sensor. For a measurement systems based upon the Hall effect, the sensor is a Hall sensor chip and the measurement element is a component which bears a magnet or include at least in part a magnetized material.

A similar arrangement is shown in published German Patent Application DE 37 17 778 A1 which illustrates that a nut of the lock mechanism is dynamically coupled to a disk-shaped intermediate element. The two components, the nut of the lock and the intermediate element, can be turned around the same axis of rotation. The intermediate element together with the nut of the lock ensures dynamic coupling between the paddle and the outside safety lever of the motor vehicle lock and therefore also assumes the function of the measurement element. To monitor the angular position of the nut of the lock a microswitch, which is the sensor of the measurement system, is provided directly on the intermediate element in a radial alignment. The intermediate element in an edge-side area has a crank which enables the microswitch to roughly detect the position of the nut of the lock.

It is particularly noted that the intermediate element of this design is made as a component which is separate from the nut of the lock so that these two components can be configured independently of one another within certain limits. This is consistent with the prerequisite for the modularization of components which seems always to be necessary in the automobile industry. The disadvantage of this approach, however, is that this arrangement of an intermediate element and a nut requires a relatively large amount of installation space due to the disk-shaped intermediate element. Additionally, the installation cost is relatively high due to the additional component—the intermediate element, and, finally, the tactile sensor principle is fault-susceptible and is subject to high wear.

There are presently other alternatives to tactile measurement, such as optical, electrical and magnetic measurement processes.

One such approach, which is based on the principle of inductive sensing, is illustrated in German Patent DE 39 41 086 C2. In this approach, strips of a magnetic material, which influence a magnetic circuit, are applied to the outside cylindrical surface of the nut of the lock mechanism and are a part of the measurement element. When the nut of the lock is turned, the strips are guided past an inductive sensor. With this arrangement, the strips can be provided in several tracks such that the position of the nut of the lock can be determined based on the inductive sensor signals. This simple approach which can be implemented with little effort, however, has the disadvantage that the nut of the lock must have an essentially planar surface. Furthermore, depending on the material of the nut of the lock, the adhesion of the strips to the nut surface can be a problem. Finally, with this approach, the nut of the lock cannot be metallic, since there would not be sufficient resolution of the measurement signal from the strips.

In the automobile industry, Hall sensors have become common in the field of motor vehicle locks. These sensors offer not only high reliability and reasonable price, but also provide highly accurate measurements.

One approach for the "contactless" determination of the angular position of the nut of the lock is illustrated in German Utility Model DE 296 18 688 U1. The underlying the principle of the Hall effect on this approach is already known. Here, a magnet is countersunk into the non-ferromagnetic wall of the nut of the lock. The non-ferromagnetic wall of the nut together with the integrated magnet represents a measurement element. When the nut of the lock turns, the embedded magnet is guided through the measurement area of the Hall sensor chip. This approach, like previously discussed constructions, presupposes that the nut of the lock consists of plastic or the like. Furthermore, the structural design of the nut is greatly limited by the fact that the magnet is countersunk into the wall of the nut of the lock.

In summary, the two known approaches to "contactless" detection of the position of the nut of a lock in the prior art are associated with disadvantages. Further, a modular concept for either approach cannot easily be implemented due the structural configuration of the nut of the lock being limited by the attachment of the magnetic material or a material which influences the magnetic circuit. However, in the automobile industry the ability to provide configurations which maximize the modular concept in order to meet a client wishes is paramount. That is, any new product line must be able to be combined with a combination of suitable standard components.

SUMMARY OF THE INVENTION

Therefore, an object of the invention is to improve the known motor vehicle lock detailed above such that "contactless" monitoring of the angular position of the nut of the lock becomes possible in a particularly compact manner while maintaining the required modular capability.

This object is achieved in a motor vehicle lock of the present invention by taking several important design factors into consideration in the motor vehicle door lock.

First of all, the measurement element be located directly on the outside cylinder surface of the nut of the lock, but at the same time be made as a component which is separate from the nut. An annular configuration, or at least annular in certain sections, of the measurement element will ensure a high degree of modular compactness which will simultaneously enable a simple installation. With such a configuration, that is the separability of the nut and the measurement element, the modular structure of the overall system is maintained. Since none of the components of the measurement system are part of nut itself, the nut can be configured largely without limitation. Care must simply be taken that the separate measurement element can be attached to the nut of the lock.

In one embodiment, a single "standard nut" can be provided which, depending on the product version and the sensor, can be combined with different measurement elements of the invention.

One particular advantage of the annular measurement element according to the invention arises in the ability to pre-assemble the components into position by injection-molding material onto the nut of the lock such a connecting bridge(s) between the nut of the lock and the measurement element is formed. The(se) connecting bridge(s) is fabricated as scored sites which break during installation. The measurement element can be moved into its final assembly position when the connecting bridge(s) is broken.

The aforementioned pre-assembly position of the measurement element can be anywhere on the nut of the lock. However, it is especially advantageous if the measurement element is aligned coaxially with the nut so that the measurement element can be moved into its final installation position by a single linear movement. In this embodiment, the measurement element can also be used as a centering aid when the nut of the lock is installed in the motor vehicle lock which reduces the installation cost.

The embodiments of the motor vehicle lock mechanism of the invention acquire a special importance when used conjunction with a measurement system employing a Hall sensor. That is, the measurement element is then preferably a plastic ring which holds one or more magnets. Therefore, as long as the mechanical orientation of the measurement element to the nut of the lock is kept constant, the structural configuration of the measurement element is optional. Furthermore, the annular measurement element of the invention can be easily replaced, if necessary, during a manufacturing shift which employs a new sensor or another evaluation process.

DETAILED DESCRIPTION OF THE INVENTION

Figure 1:
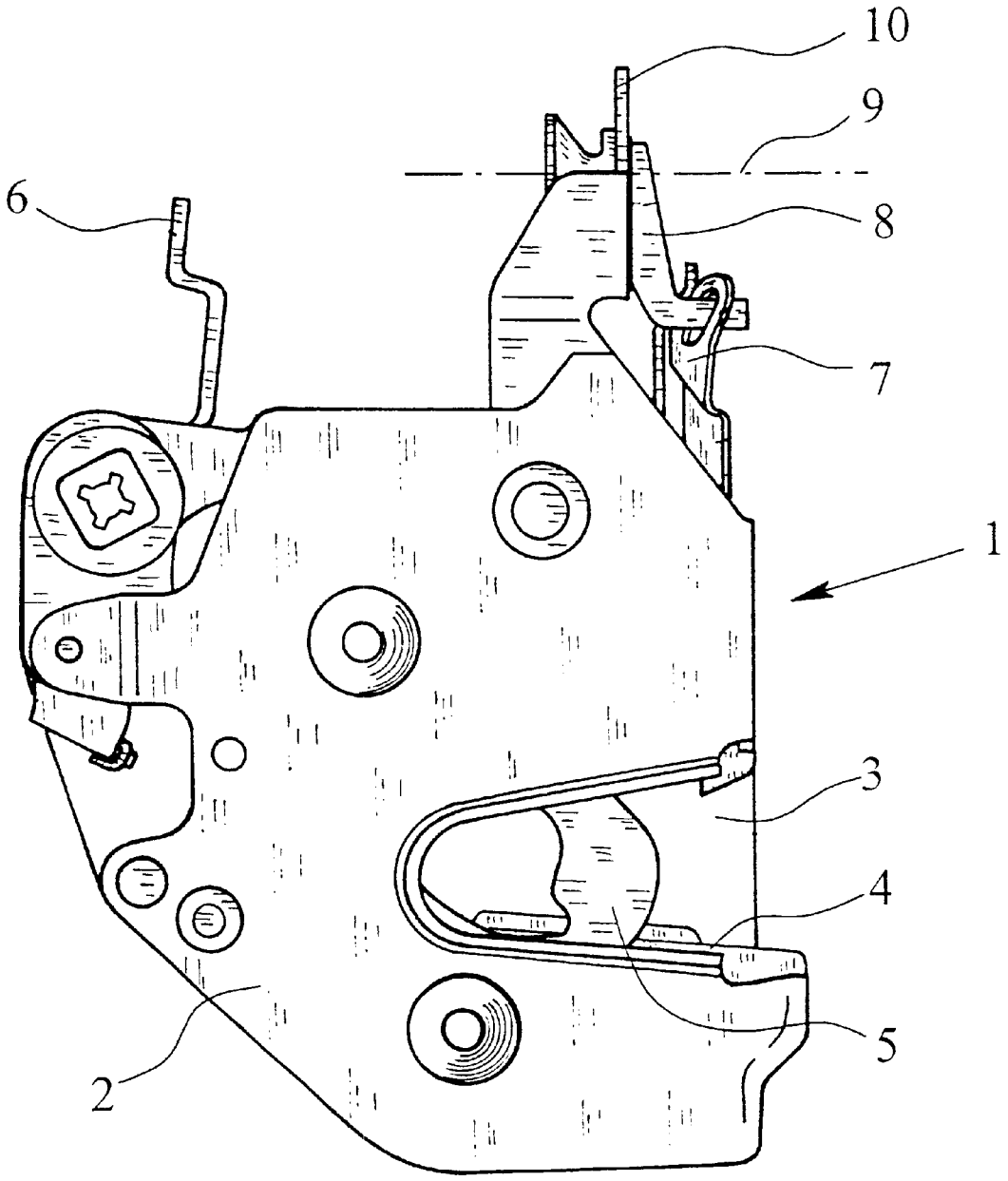
FIG. 1 schematically illustrate in an overview a motor vehicle lock.

FIG. 1 shows a motor vehicle lock 1 of the type employed in the door of a motor vehicle which can be locked from the outside, preferably with a key and locking cylinder. The motor vehicle lock 1 has a lock housing 2 which holds the lock mechanism and in which there is formed a catch bearing 3 which includes the feed slot 4 in which a rotary latch 5 is viewed in the lock position. Also shown in FIG. 1 are the outside actuating lever 6 and the outside safety lever 7 of the lock mechanism.

To actuate the outside safety lever 7, a force application element is shown as being in the form of the nut 8 which can turn around an axis 9 of rotation and is preferably essentially cylindrical. To hold the nut 8 of the lock in place a corresponding support 10 for the nut is provided. When installed with the motor vehicle lock 1, the nut 8 is dynamically coupled on one side to a paddle (not shown here) and on another side to the outside safety lever 7. Components for fixing the angular position of the nut 8 of the lock are not shown by FIG. 1.

Figure 2:
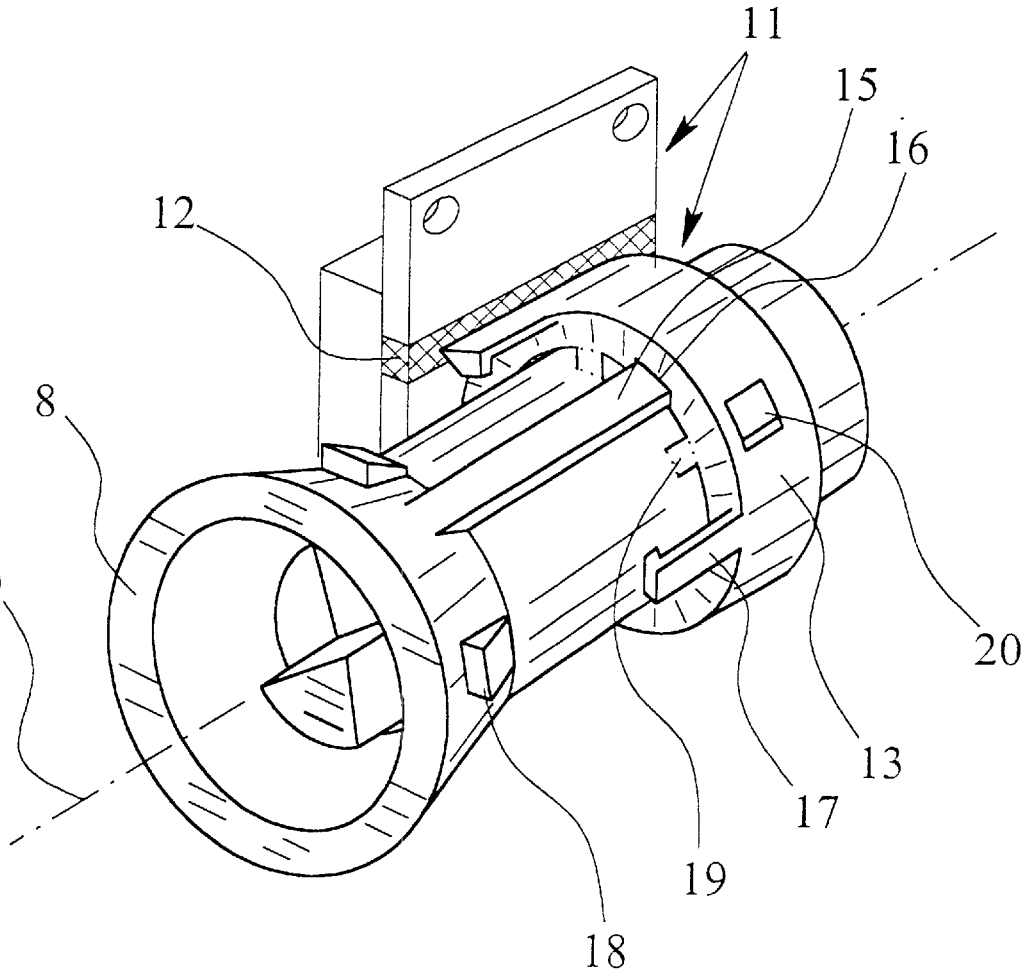
FIG. 2 illustrates the nut of the lock in one embodiment of the invention having a closed, annular measurement element.

The motor vehicle lock 1 described here has, as shown in FIG. 2, a measurement system 11 for detecting the position of the nut 8. The measurement system 11 has at least one stationary sensor 12 and at least one measurement element 13 which is dynamically coupled to the nut 8. The measurement element 13 is characterized by different areas each of which result in different sensor reactions within the measurement range of the sensor 12. According to this embodiment, the location of the measurement element 13 can be detected within certain limits as long as the measurement element 13 is located at least during portions of the rotation of the nut in the measurement range of the sensor 12. When the measurement element 13, as described above, is dynamically coupled to the nut 8 of the lock, it is possible to determine the position of the nut 8 of the lock via the location of the measurement element 13.

FIG. 2 shows an embodiment of the nut 8 and the measurement element 13 in the un-installed state just prior to installation. For installation purposes, the nut 8 of the lock is inserted into a mounting hole (not shown here) and fitted into the support 10 of the nut of the lock. The nut 8 of the lock and the measurement element 13 are then in their respective final installation position. The mounting hole of the support 10 for the nut, in a preferred embodiment, can be made as desired in order to structurally coincide with the nut.

The sensor 12 of the measurement system 11 is located stationary in the immediate vicinity of the nut 8 of the lock, and its design is largely optional depending on the structural configuration of the lock mechanism. It is also possible to place the sensor 12 farther away from the nut 8 of the lock when the measurement element 13 is configured to account for such a location.

The measurement element 13 according to a preferred embodiment is made essentially annular. When the nut 8 of the lock is installed, the annular measurement element 13 at least partially borders the nut 8 of the lock. This largely interlocking combination of the nut 8 of the lock and the measurement element 13 provides for an especially space-saving arrangement.

In FIG. 2, the measurement element 13 is structured to annularly enclose the nut 8 over the entire periphery of the nut 8. In this embodiment, the high stability of the closed ring shape and the low cost in the attachment of the measurement element 13 to the nut 8 of the lock are advantageous.

Figure 3:
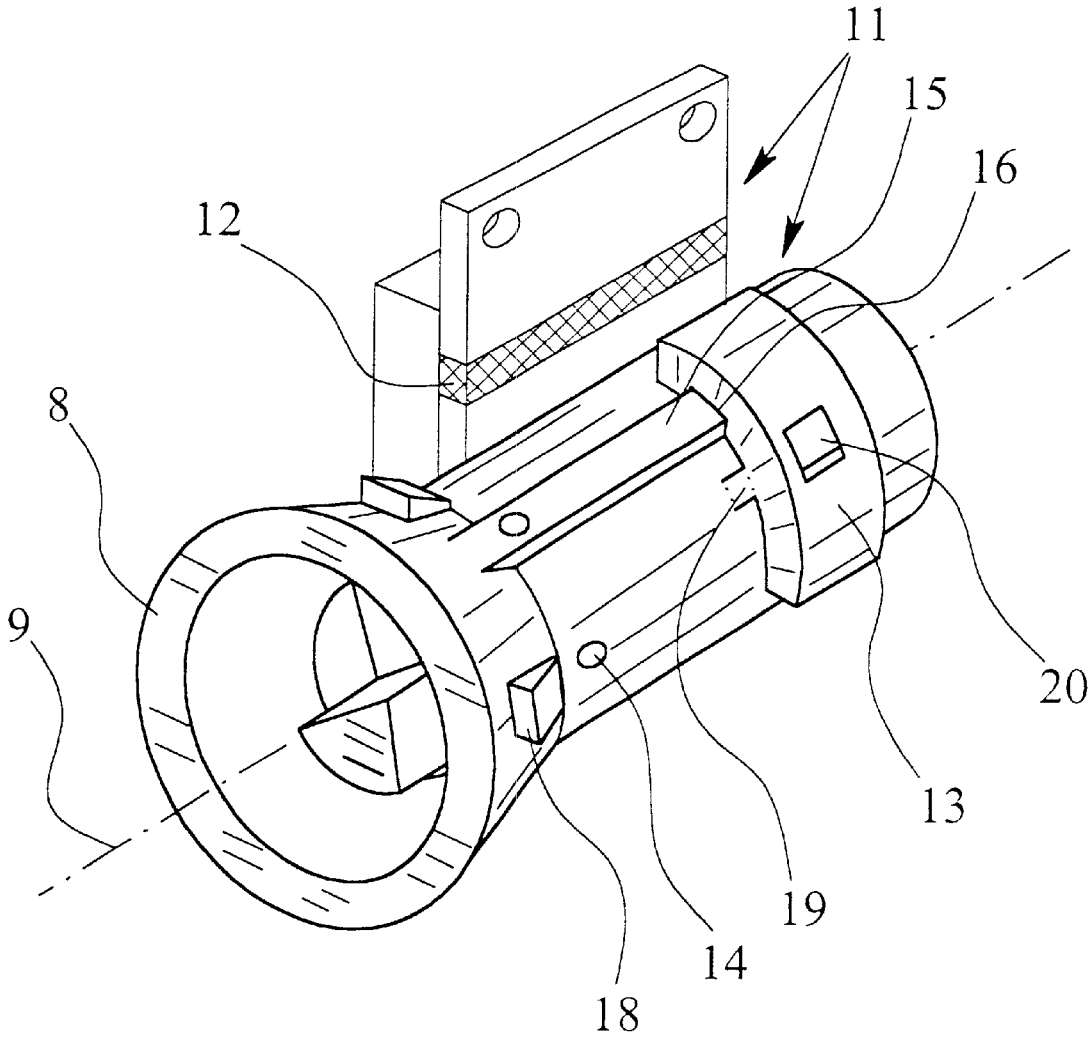
FIG. 3 illustrates the nut of the lock in another embodiment of the invention in which the annular measurement element is in sections.

However, as shown in FIG. 3, it is also within the scope of the present invention for the measurement element 13 to only partially surround the periphery of the nut, the measurement element 13 being provided as segments of a ring which are separable from one another. The ring segments are then attached via their own guides or, preferably, via plug devices with a corresponding mounting hole(s) 14 with their curvature being coaxial to the periphery of the nut in the same manner as when the measurement element is annular. When there is a principal demand for compactness, this approach can be a great advantage. Of course, the latter embodiment can provide multiple segments or only one single ring segment, as shown in FIG. 3.

It is particularly emphasized that the measurement element 13 and the nut 8 of the lock are made separate from one another and are dynamically coupled components when in use. This physical separation of the two components is especially advantageous when modularity is desired, as was discussed previously.

The dynamic coupling between the measurement element 13 and the nut 8 of the lock can be both via a rigid coupling or a "loose" coupling with a "freewheel" provided in certain positions. This "freewheel" embodiment would be necessary for certain operating uses of the lock mechanism, and can also simplify the evaluation of sensor signals.

In this rigid embodiment, the nut 8 of the lock has on its outside cylinder surface at least one bridge 15 which is aligned parallel to the axis 9 of rotation. The measurement element 13 has one or more corresponding grooves 16. In the installed state, i.e., when the nut 8 of the lock and the measurement element 13 are each in the final installation position, the bridge(s) 15 of the nut 8 fits into the corresponding groove(s) 16 of the measurement element 13. This interlocking provides the advantage that the measurement element 13 can be positioned very accurately on the nut 8 of the lock.

As an alternative to this orientation, the nut 8 of the lock can be provided with a groove(s), and, accordingly, the inner annular surface of the measurement element 13 can be provided with a complementary interlocking bridge(s).

When the bridge 15 or the groove of the nut 8 extends essentially over the entire length of the nut 8 of the lock, a guide aid results when the measurement element 13 is slipped onto the nut 8 of the lock thereby avoiding a time-consuming threading effort.

In a preferred embodiment, the measurement element 13 has at least one locking element 17 and that the nut 8 of the lock has at least one corresponding locking counter-element 18. Preferably, the locking element 17 is a hook and the locking counter-element 18 is a shoulder. When the final installation position of the measurement element 13 is reached the hook element snaps into the shoulder so that the measurement element 13 is secured in its final installation position. This attachment is especially advantageous because the structural cost for the nut 8 of the lock is particularly low. As is apparent, this mode of attachment enables easy interchangeability of the measurement element 13 with a differently structured measurement element having the same type of locking elements.

While the annular configuration of the measurement element 13 having a guide aid, provided by corresponding bridges and grooves, and having hooks and shoulders, provided for joining the nut 8 and measurement element 13, greatly simplifies the installation, there still another embodiment for simplifying the installation. That is, the measurement element 13 is fixed in the un-installed position, via at least one connecting bridge 19, at a pre-assembly position on the nut 8 of the lock.

The connecting bridges 19 are fabricated to be scored sites which rupture or break during the installation process of the nut 8 when the measurement element 13 is moved into its final installation position. Preferably, these connecting bridges 19 are produced by a plastic molding injection process. Consequently, the measurement element 13 no longer needs be supplied as a separate component for installation, but is already fixed on the nut 8 in a pre-assembly position awaiting final assembly of the measurement element 13 on the nut 8 of the lock. Note, that except for this pre-assembly positioned, the previously mentioned advantage of maintaining physical separation of the measurement element 13 and the nut 8 remains as an advantage.

In an especially preferred embodiment, the measurement element 13 is aligned coaxially to the nut 8 of the lock in its pre-assembly as shown in both FIGS. 2 and 3. For either embodiment, when the measurement element 13 is pressed in the axial direction of its final installation position, the connecting bridge(s) 19 fractures or breaks as soon as sufficient axial force is applied. Thus, the measurement element 13 can be moved into its final installation position by a single linear motion.

In addition to the aforementioned minimization of the installation cost by omitting the threading of the measurement element 13 onto the nut 8 of the lock, the above described embodiments also simplify the insertion of the nut 8 of the lock into the corresponding mounting hole in the support 10 for the nut of the lock. This insertion process requires considerable feel, since the nut 8 of the lock must be centered in the mounting hole. The required centering is simplified by the measurement element 13, which is still in the pre-assembly position, by inserting the measurement element 13 a short distance into the mounting hole and abutting against a stop which is present there. The installation force then acts via the connecting bridges 19 directly on the aforementioned stop. When a force necessary to fracture the bridge(s) 19 is exceeded, the connecting element(s) 19 breaks and the nut 8 of the lock is pushed through the measurement element 13. During this process, the measurement element 13 continues to have a centering effect on the nut 8 until the nut 8 has reached its final installation position. The described guide aid leads to a further reduction of the installation cost and simplification of the installation process. This latter embodiment is particularly advantageous when the motor vehicle lock 1 is mounted, at least partially, by an automated process, e.g., using a robot. Possible tolerance problems which can occur in automated handling can be neutralized by the guide aid.

The particular location of the pre-assembly position of the measurement element 13 along the axis 9 of rotation of the nut 8 is largely optional and can be dependent on structural circumstances, for example, on the configuration or positioning of the mounting hole 14.

The embodiments discussed above can of course be applied to almost any measurement device or process. Numerous measurement devices are known in the prior art. For example, Hall sensors have become quite popular in the automobile industry due to the low price associated with a compact construction and high degree of accuracy. The Hall sensor is also especially favorable for the above described invention since the annular measurement element 13 can also easily accommodate one or more magnets 20. Depending on the position of the nut 8, and thus, of the measurement element 13, detection of the measurement element 13 by the sensor 12 is possible which enables determination of the position of the nut 8 of the lock. The magnet(s) 20 can be connected in any manner to the measurement element 13; for example, countersinking, injection molding, cementing, clamping or the like are alternatives for attaching the magnet (s) 20 to the measurement element 13.

Other sensor types which can be easily used with the above described embodiments are capacitive or inductive sensors, as well as eddy current sensors. For these type of sensors, the measurement element 13 would bear influencing components, which can be, for example, metal components attached as mentioned above to the measurement element 13.

Of course the measurement element 13, when capacitive or inductive or eddy current sensors are employed, may not be composed of ferromagnetic or electrically conductive material. Preferably, the measurement element 13 is made of a plastic material which has one or more influencing components such as magnets or metal elements. However, it should be noted that, with a suitable arrangement of the sensor(s) 12, the nut 8 of the lock can be fabricated from a conductive or ferromagnetic material.

Another efficient technique for measurement that can be employed with the above mentioned nut and measurement element arrangement is optical scanning of the measurement element 13. That is the measurement element 13 is fabricated with sections having different optical properties. For example, the measurement element 13 can bear one or more reflectors on its surface, or certain sections of the measurement element 13 can have different colors or different levels of transparency. Additionally, the measurement element 13 can be fabricated with recesses which can be detected by an optical sensor. For each of these embodiments, the material of the measurement element 13 is not relevant as long as the surface of the measurement element 13 has the required differential optical properties.

What is claimed is:

1. Motor vehicle door lock comprising a lock mechanism including a force application element in the form of an essentially cylindrical nut adapted to rotate around an axis of rotation, a measurement system for detecting the position of the nut including at least one stationary sensor and a least one measurement element which is dynamically coupled to the nut and located in a measurement range of the sensor in order to be detected for determining the location of the at least one measurement element, and, as a result, the location of the nut, wherein the nut and the measurement element are separate components and are dynamically coupled in the installed state, wherein the measurement element is positioned in an essentially coaxial relation to the nut in an un-installed state and wherein the nut is at least partially enclosed by the measurement element in an installed state.

2. Motor vehicle door lock as claimed in claim 1, wherein the measurement element has an annular configuration which essentially encloses the nut.

3. Motor vehicle door lock as claimed in claim 1, wherein the nut and the measurement element are dynamically coupled, separate components.

4. Motor vehicle door lock as claimed in claim 1, wherein the measurement element, in the un-installed state, is connected coaxially at a pre-assembly position relative to the nut via at least one connecting bridge, wherein the at least one connecting bridge is adapted to break upon application of sufficient installation force acting in a direction of the axis of rotation of the nut.

5. Motor vehicle door lock as claimed in claim 4, wherein the position of the measurement element in the installed state is obtainable from a pre-assembly position via linear displacement of the measurement element along the axis of rotation of the nut.

6. Motor vehicle door lock as claimed in claim 1, wherein the sensor is a Hall sensor and the measurement element has at least one magnet positioned on the periphery of the measurement element.

7. Motor vehicle door lock as claimed in claim 6, wherein the at least one magnet is embedded in the peripheral surface of the measurement element.

8. Motor vehicle door lock as claimed in claim 1, wherein the sensor is one of a capacitive, inductive and eddy current sensor, and wherein the measurement element has at least one influencing component positioned around the periphery of the measurement element.

9. Motor vehicle door lock as claimed in claim 8, wherein the at least one influencing component is made of metal.

10. Motor vehicle door lock as claimed in claim 9, wherein the at least one metal influencing component is embedded in the measurement element.

11. Motor vehicle door lock as claimed in claim 1, wherein the measurement element is essentially made of a plastic material.

12. Motor vehicle door lock as claimed in claim 1, wherein the sensor is an optical sensor, and wherein the measurement element has at least one optically reflective element positioned on the periphery of the measurement element.

13. Motor vehicle door lock as claimed in claim 1, wherein the sensor is an optical sensor, and wherein the measurement element has different optical properties on different sections of the periphery of the measurement element.

14. Motor vehicle door lock as claimed in claim 1, wherein the sensor is an optical sensor and sections on the periphery of the measurement element have different shapes.

15. Motor vehicle door lock comprising a lock mechanism including a force application element in the form of an essentially cylindrical nut adapted to rotate around an axis of rotation, a measurement system for detecting the position of the nut including at least one stationary sensor and a least one measurement element which is dynamically coupled to the nut and located in a measurement range of the sensor in order to be detected for determining the location of the at least one measurement element, and, as a result, the location of the nut, wherein the measurement element is positioned in an essentially coaxial relation to the nut in an un-installed state and wherein the nut is at least partially enclosed by the measurement element in an installed state wherein the nut is provided on an essentially cylindrical outside surface with at least one bridge which is aligned parallel to the axis of rotation, and wherein the measurement element is provided with at least one groove on an inner annular surface thereof, said at least one groove being aligned parallel to the axis of rotation such that the at least one groove interlocks with the at least one bridge at least in an installed state of the measurement element.

16. Motor vehicle door lock as claimed in claim 15, wherein the bridge of the nut extends essentially over the length of the nut.

17. Motor vehicle door lock as claimed in claim 15, wherein the sensor is a Hall sensor and the measurement element has at least one magnet positioned on the periphery of the measurement element.

18. Motor vehicle door lock as claimed in claim 17, wherein the at least one magnet is embedded in the peripheral surface of the measurement element.

19. Motor vehicle door lock as claimed in claim 15, wherein the sensor is one of a capacitive, inductive and eddy current sensor, and wherein the measurement element has at least one influencing component positioned around the periphery of the measurement element.

20. Motor vehicle door lock as claimed in claim 15, wherein the measurement element is essentially made of a plastic material.

21. Motor vehicle door lock comprising a lock mechanism including a force application element in the form of an essentially cylindrical nut adapted to rotate around an axis of rotation, a measurement system for detecting the position of the nut including at least one stationary sensor and a least one measurement element which is dynamically coupled to the nut and located in a measurement range of the sensor in order to be detected for determining the location of the at least one measurement element, and, as a result, the location of the nut, wherein the measurement element is positioned in an essentially coaxial relation to the nut in an un-installed state and wherein the nut is at least partially enclosed by the measurement element in an installed state wherein an outside cylindrical surface of the nut has at least one groove which is aligned parallel to the axis of rotation, and wherein the measurement element has at least one bridge on an inner annular surface thereof which interlocks with the at least one groove of the nut at least in an installed state of the measurement element.

22. Motor vehicle door lock as claimed in claim 21, wherein the groove of the nut extends essentially over the length of the nut.

23. Motor vehicle door lock as claimed in claim 21, wherein the sensor is a Hall sensor and the measurement element has at least one magnet positioned on the periphery of the measurement element.

24. Motor vehicle door lock as claimed in claim 23, wherein the at least one magnet is embedded in the peripheral surface of the measurement element.

25. Motor vehicle door lock as claimed in claim 21, wherein the sensor is one of a capacitive, inductive and eddy current sensor, and wherein the measurement element has at least one influencing component positioned around the periphery of the measurement element.

26. Motor vehicle door lock as claimed in claim 21, wherein the measurement element is essentially made of a plastic material.

27. Motor vehicle door lock comprising a lock mechanism including a force application element in the form of an essentially cylindrical nut adapted to rotate around an axis of rotation, a measurement system for detecting the position of the nut including at least one stationary sensor and a least one measurement element which is dynamically coupled to the nut and located in a measurement range of the sensor in order to be detected for determining the location of the at least one measurement element, and, as a result, the location of the nut, wherein the measurement element is positioned in an essentially coaxial relation to the nut in an un-installed state and wherein the nut is at least partially enclosed by the measurement element in an installed state wherein the measurement element has at least one locking element, and the nut has at least one locking counter element which joins with the at least one locking element of the measurement element in the installed state thereof.

28. Motor vehicle door lock as claimed in claim 27, wherein the at least one locking element is a hook element and the at least one locking counter element is a shoulder.

* * * * *